United States Patent [19]

Pease et al.

[11] 4,198,179

[45] Apr. 15, 1980

[54] PRODUCTION RISER

[75] Inventors: Floyd T. Pease, London, England; Donald R. Ray, Houston, Tex.; Riddle E. Steddum, Houston, Tex.; Bruce L. Crager, Houston, Tex.

[73] Assignee: The Offshore Company, Houston, Tex.

[21] Appl. No.: 932,865

[22] Filed: Aug. 11, 1978

[51] Int. Cl.[2] ..... B63B 35/44; E21B 7/12; B63B 21/00

[52] U.S. Cl. ..... 405/195; 166/359; 175/7; 405/202

[58] Field of Search ..... 405/195–209, 405/224–227, 169, 170; 175/5–10; 166/350, 359, 367

[56] References Cited

U.S. PATENT DOCUMENTS

| | | | |
|---|---|---|---|
| 3,454,116 | 7/1969 | Hunsucker | 175/7 |
| 3,508,409 | 4/1970 | Cargile | 405/195 |
| 3,528,497 | 9/1970 | Lehman | 175/7 X |
| 3,554,277 | 1/1971 | Bauer | 175/7 X |
| 3,559,410 | 2/1971 | Blenkarn et al. | 175/7 X |
| 3,559,411 | 2/1971 | Blenkarn | 405/225 |
| 3,638,721 | 2/1972 | Harrison | 175/7 X |
| 3,817,325 | 6/1974 | Mott et al. | 166/359 |
| 3,983,706 | 10/1976 | Kalinowski | 175/7 |
| 4,142,584 | 3/1979 | Brewer et al. | 175/7 X |

*Primary Examiner*—Dennis L. Taylor
*Attorney, Agent, or Firm*—Vinson & Elkins

[57] ABSTRACT

A riser for production of oil and gas in a marine location with the riser connected to the casing supported at the mud line of a body of water and extending upward in the water to a tension moored floating structure. The riser includes a flexible joint near its connection to the casing and is supported at its upper end from the floating structure and is also supported from the floating structure at a point between 50 and 175 feet below the water level. A production string extends upwardly from the producing zone through the casing, the flexible joint and the riser to the floating structure and wellhead equipment is supported on such riser. Centralizers are provided for the production string with the centralizer immediately above the flexible joint being between 35 to 65% of the total distance between such centralizer and the centralizer positioned immediately below the flexible joint.

12 Claims, 9 Drawing Figures

10
48
50
52
50
54
78
83

64
66
72
70
74
62
24
60
80
68
64
60
76
70
10
62
78
72
64
60
82
74
66
78
10
82
24

Fig. 7
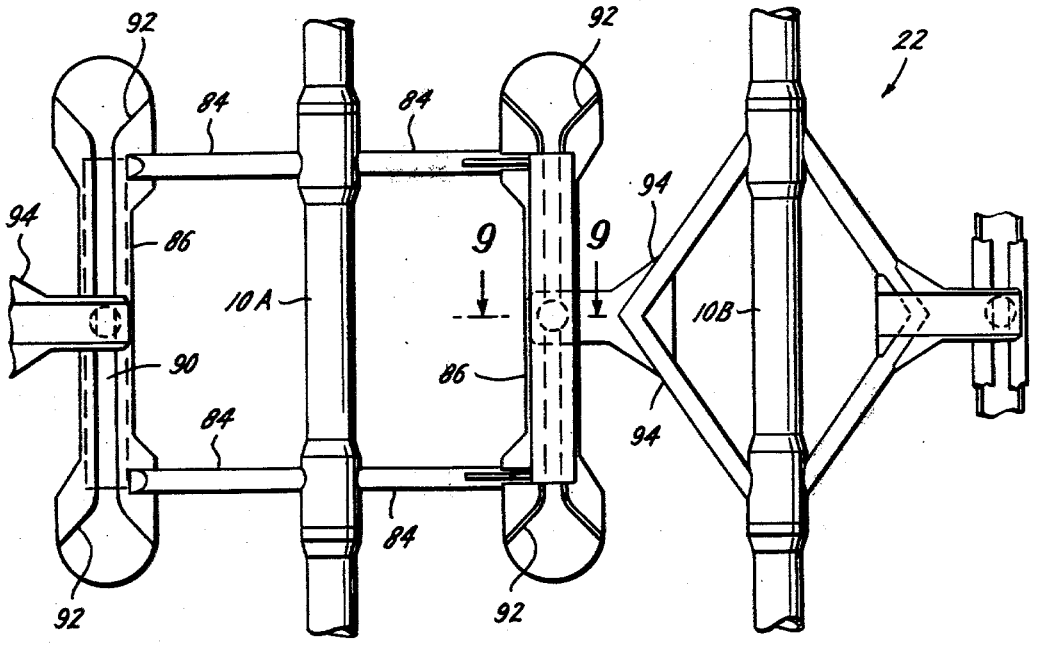
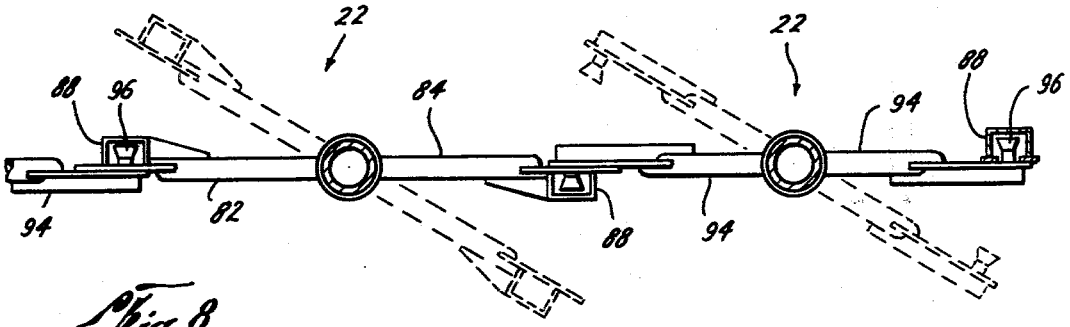
Fig. 8
Fig. 9
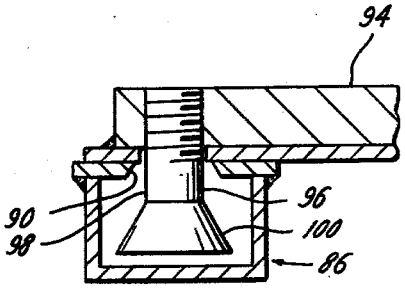

PRODUCTION RISER

BACKGROUND

The drilling of oil and gas wells in deep water has resulted in reaching the economic limits of bottom supported structures. Such bottom supported structures have reached their economic feasibility limit at depths between 500 feet to 1500 feet. In such range and deeper drilling and production are handled from floating structures. The movements of such floating structures creates serious problems of excess bending of production strings. To avoid this problem marine risers have been used to surround the production tubing. In such production systems, the floating structure cannot support the marine riser at various points along its entire length as could be done with a bottom-supported structure. Also, such marine riser systems have required subsea wellhead equipment and a disconnection of the riser and production strings with the occurrence of storm conditions.

The W. A. Hunsucker U.S. Pat. No. 3,454,116 provides external trusses and outwardly spaced tension members in an attempt to stiffen a riser pipe.

The K. A. Lehman U.S. Pat. No. 3,528,497 discloses a structure for supporting and positioning the upper end of a marine drilling string.

The K. A. Blenkarn et al U.S. Pat. No. 3,559,410 discloses supports for tension mooring members at the top and bottom to relieve stresses therein.

The K. A. Blenkarn U.S. Pat. No. 3,559,411 discloses a cable and pulley system coacting with mooring pipes to distribute the heave forces to the pipe.

The G. E. Mott et al U.S. Pat. No. 3,817,325 discloses a submarine conduit which is laterally reinforced by tension lines extending between vertically spaced arms extending outward from the conduit.

An article entitled "A 4,000-Foot Riser" by L. R. Heuze et al in the April 1976 edition of Journal of Petroleum Technology discusses the problems of production risers in deep water. It suggests a second support about 50 feet under the spider to reduce bending moments at the top of the riser.

SUMMARY

The present invention relates to an improved marine production riser. The riser is connected to a casing string supported at the mud line, has a flexible joint near the bottom, has a production tubing string therein with centralizers supporting it within the riser above and below the flexible joint, has a means for interconnecting intermediate portions of adjacent risers, includes a removable support from 50 to 175 feet below the waterline from the tension moored floating structure and has wellhead production equipment positioned on the top of the riser to control production.

The improved riser structure of the present invention could remain connected even in heavy seas where prior art risers have had to be disconnected at the bottom and production shut in. By remaining connected, even though the subsurface safety valve may be closed and the pressure on the production string or strings is bled, the riser of the present invention provides a much greater period of production because re-activation of production does not require the reconnection of the riser and production tubing but merely opening of the subsurface safety valve.

BRIEF DESCRIPTION OF THE DRAWINGS

These and other advantages of the present invention are hereinafter set forth and explained with reference to the drawings wherein:

FIG. 7 is an elevational view of the interconnecting structure between intermediate portions of adjacent parallel risers.

FIG. 8 is a plan view of such riser interconnecting structure with the unconnected position shown in dashed lines.

FIG. 9 is a detailed sectional view of such riser interconnecting structure taken along line 9—9 in FIG. 7.

DESCRIPTION OF THE PREFERRED EMBODIMENTS

Figure 1:
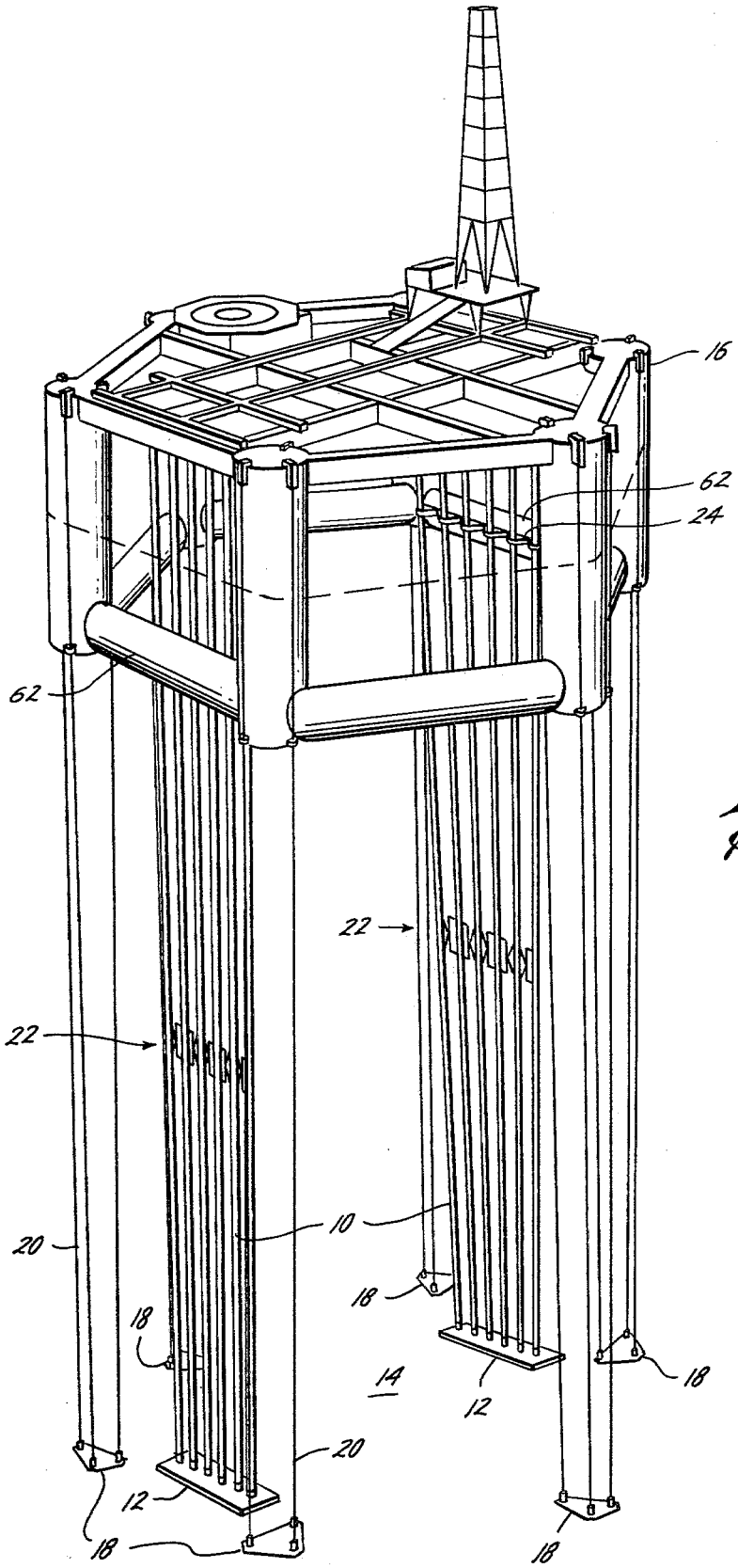
FIG. 1 is a perspective view of a floating structure having a plurality of the improved production risers of the present invention connecting from the bottom template to the floating structure.

A plurality of the improved production risers 10 are shown in FIG. 1 extending from the templates 12 on bottom 14 to the tension moored floating structure 16. The floating structure 16 has a plurality of anchors 18 which are connected to the floating structure by a plurality of parallel tensioned lines 20 each of which is generally vertically positioned and extends from its anchor 18 to the floating structure 16. Thus, floating structure 16 is tension moored and has a minimum of movement responsive to tide, current, wind and waves. To maintain spacing between the risers 10 the adjacent risers 10 are interconnected to each other as shown at 22 in FIG. 1 and hereinafter explained with reference to FIGS. 7, 8 and 9. Also the risers 10 are supported at the template 12, from the floating structure at or above the surface and at a level between 50 to 175 feet below the water surface by the removable support 24 extending from the lower part of floating structure 16.

Figure 2:
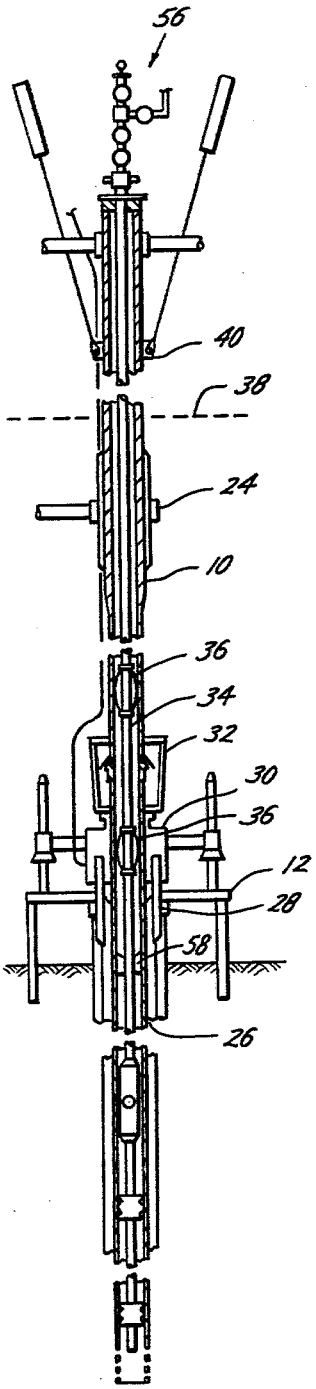
FIG. 2 is a sectional view of portions of the improved production riser.

The support for the lower end of the risers 10 is shown in FIG. 2 wherein the casing 26 is supported from casing head 28 at the mud line and the riser 10 is an upward extension of the casing 26. The casing 26 extends through the connector 30 to the flexible joint 32. This flexible joint 32 is the type of joint which is self-centering and has a centering force exerted to bring the joint sections back into alignment once they have been displaced. Such a joint is supplied by Oil States Rubber Co. of Arlington, Tex. and is identified as "The Master Connector."

The production string or tubing 34 is within casing 26 and extends through connector 30 and flexible joint 32 into the riser 10. The centralizers 36 are positioned above and below the flexible joint 32. It is preferred that the distance from the center of rotation of flexible joint 32 and the upper centralizer 36 be in the range from 35 to 65 percent of the total distance between the two centralizers 36. While only a single production string 34 is shown, several strings may extend through each riser 10.

Figure 3:
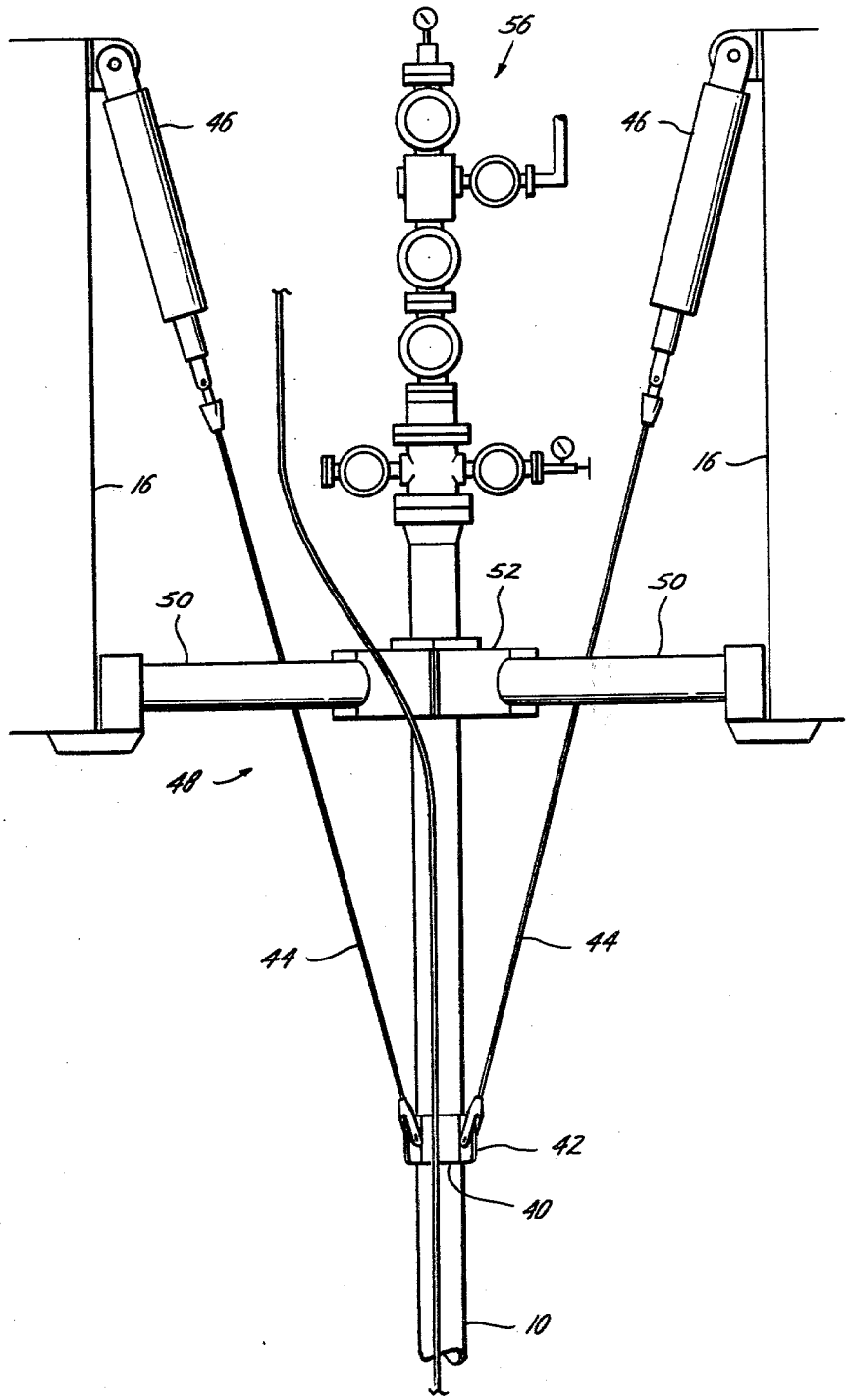
FIG. 3 is an elevation view of the support structure for the production riser above the surface on the floating structure.

The upper end of riser 10 is carried above the water level 38 from the floating structure 16, as shown in FIGS. 2 and 3. A collar 40 is secured around the exterior of the riser 10 and has a plurality of projections 42 to which the cables 44 are connected. The other end of the cables 44 are connected to the actuators or tensioners 46 which are mounted on the floating structure 16. By properly preloading the actuators 46, a preselected tensile force or upward pull can be exerted on the upper end of riser 10. The cables 44, the actuators 46 and the collar 40 provide a tensioning system for the riser 10.

Figures 4, 5, 6:
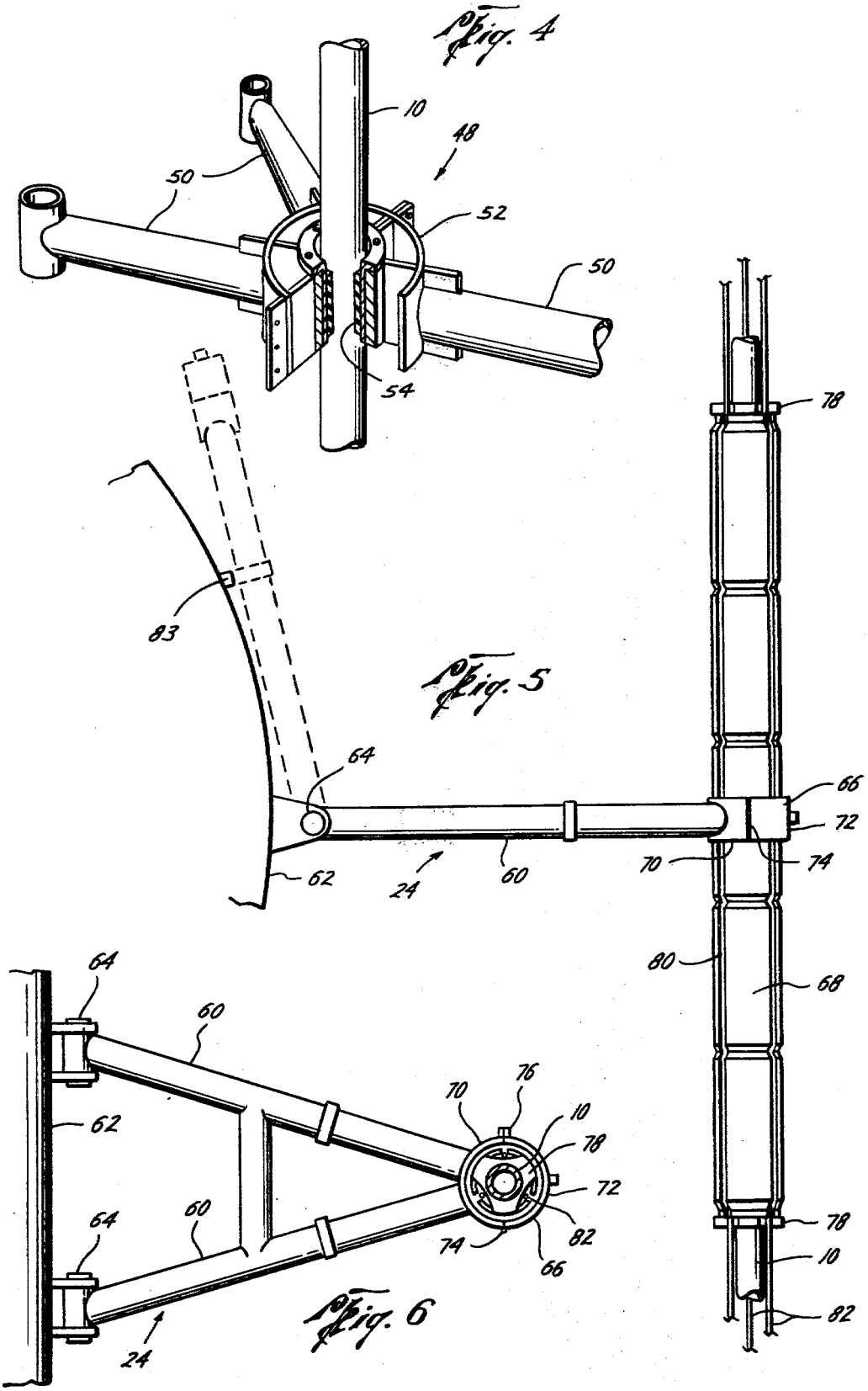
FIG. 4 is a perspective detail of such support structure for the riser with portions broken away to illustrate sections thereof.
FIG. 5 is an elevation view of the lower riser support from the floating structure with the retracted position of the support being shown in dashed lines.
FIG. 6 is a plan view of the support structure shown in FIG. 5.

The end of riser 10 above collar 40 passes through the support assembly 48 as shown in FIGS. 3 and 4. The support assembly 48 includes a plurality of radial arms 50 each of which is supported at its outer end from the floating structure 16 and a central collar 52 having a resilient inner sleeve 54 through which the riser 10 extends. As best seen in FIGS. 2 and 3 the well head equipment 56 is connected to the riser 10 above support assembly 48.

The support assembly 48 provides lateral support for the upper end of riser 10 and the tensioning system provides sufficient force to support the weight of the riser 10, the production string 34 above the tubing hanger 58, the well head equipment 56 and additional tension force to minimize riser sag and prevent compressive buckling failure from riser bending.

In addition to the lateral support of support assembly 48, the support 24 provides additional lateral support for the riser 10. Support 24 is shown in FIGS. 5 and 6 includes the legs 60, each of which is pivotally mounted to the lower hull 62 of the floating structure 16 by the hinges 64. This allows the support 24 to be pivoted upward allowing the running of blowout preventor stacks and other large equipment. The legs 60 converge toward and are secured to collar 66 which is in supporting position surrounding riser 10 and its wear sleeve 68. Collar 66 includes an arcuate base 70 secured to legs 60 and an arcuate closure 72 pivotally mounted to base 70 by the hinge 74 and secured thereto by latch 76. Wear sleeve 68 is assembled on a section of riser 10 which is to be supported by support 24 and includes the tubular sleeve 68 and the end rings 78. The sleeve 68 has a plurality of longitudinal external grooves 80 in which the control lines 82 are positioned to protect them against wear as the riser 10 and wear sleeve 68 move through collar 66.

During running or retrieving of the riser 10 the support 24 is pivoted on hinges 64 to the position shown in dashed lines in FIG. 5. Also the latch 83 is provided to retain support 24 in its retracted position to assure that it does not interfere with the movement of riser 10 or cause unnecessary wear of the riser 10.

The interconnection of the intermediate portions is provided by the connectors 22 to maintain desired spacing between the risers. The details of such connectors 22 is shown in FIGS. 7, 8 and 9. Risers 10A and 10B are shown in FIGS. 7 and 8. Upper and lower arms 84 extend outwardly from riser 10A in opposite directions and support the longitudinally extending receptacles 86. The receptacles 86 are in the form of a box structure 88 (FIG. 9) having a narrow opening 90 throughout most of the extent of structure 88. Each opening 90 expands at each end thereof into the full size openings 92 each opening outwardly from opening 90. The openings 90 and 92 on the right hand side of riser 10A face inwardly of the drawing in FIG. 7 and the openings 90, 92 on the left hand side of riser 10A face outward of the drawing. The openings 90 are sufficiently long to accommodate relative vertical motion between the risers without releasing the connection.

The riser 10B includes the opposed converging legs 94 each having the tapered plug 96 supported at its outer end. The plug 96 includes a cylindrical shank 98 and an enlarged outer end 100 which is larger in its transverse dimension than the opening 90 but smaller than the opening 92. When the two plugs 96 are positioned within the central portion of box structures 88 as shown in FIG. 8 in solid lines the risers 10A and 10B and interconnected by the connectors 22.

To install the risers 10 and bring the connectors into engagement, at least one of the risers 10 is lowered into position on the underwater template 12. If the first riser in position is riser 10A then riser 10B is lowered until its plug 96 is opposite the upper opening 92. With riser 10A oriented so that its arms 84 extend toward and away from riser 10B, riser 10B is rotated from the dashed position shown in FIG. 8 to the solid position. Thereafter riser 10B is further lowered to position the riser 10B on the casing head 28 and the plug 96 is then positioned in the intermediate point of box structure 88 as shown in FIG. 7.

Subsequent risers 10 can be lowered and rotated to interconnect their connectors 22 with those of the risers already in position.

In order to remove any riser, it is raised sufficiently to position the plug 96 in openings 92. Clockwise rotation of the riser then releases its connection to its adjacent risers and it may be retrieved to the floating structure 16 without interferring with the other risers.

An analysis of the deflections and bending moments for various structural conditions is shown in Table A. Such analysis relates directly to a structure in 600 feet of water with a wave period of 16 seconds to a wave height of 100 feet to a maximum offset of 90 feet (15% of water depth) to a current velocity of 2 knots and with the guide positioned 80 feet below the surface waterline.

TABLE A

| RESTRAINT CONDITIONS | | | | | DEFLECTIONS | | | | |
|---|---|---|---|---|---|---|---|---|---|
| Guide | | Bottom Conditions | | | Riser Angle (deg.) | | Max. Deflection (ft.) | | Max. Bending Moment |
| With | Without | Spring | Pinned | Fixed | Bottom | Top | Vert. | Hor. | ($10^6$ in.-lb.) |
| X | | X | | | 10.2 | 6.6 | 10 | 95 | 3.6 |
| X | | | X | | 18.2 | 6.3 | 11 | 95 | 3.2 |
| X | | | | X | 0 | 6.9 | 11 | 95 | 6.7 |
| | X | X | | | 14.0 | 22.7 | 27 | 130 | 5.0 |
| | X | | X | | 25.8 | 23.2 | 29 | 132 | 3.7 |

TABLE A-continued

| RESTRAINT CONDITIONS | | | | | DEFLECTIONS | | | | |
|---|---|---|---|---|---|---|---|---|---|
| Guide | | Bottom Conditions | | | Riser Angle (deg.) | | Max. Deflection (ft.) | | Max. Bending Moment ($10^6$ in.-lb.) |
| With | Without | Spring | Pinned | Fixed | Bottom | Top | Vert. | Hor. | |
| | X | | | X | 0 | 23.0 | 28 | 131 | 9.3 |

As can be seen from Table A, the structures not utilizing the guide of the present invention (support 24) have either extremely high riser angle deflections at the top and bottom or high bending moments. With the guide (support 24) and with the spring loaded lower end of the riser (flexible joint 32) an optimum of low angular deflections, minimum deflections and low maximum bending moment are achieved. The guide with a pinned bottom appears at first glance to provide proper restraints but the large (18.2°) riser angle at the bottom is unusually high. A slightly higher maximum bending moment for the spring loaded case (3.6 compared to 3.2) can be accepted to reduce the bottom angular deflection to an acceptable deflection. A modest increase in wall thickness can accommodate such higher moment. Thus, the improved structure of the present invention provides the optimum structure.

What is claimed is:

1. A marine riser for connecting from a tension moored floating structure to a submarine, mud line suspended, casing and casing hanger, comprising
a tubular riser,
a flexible joint,
means connecting the flexible joint to the casing near the casing hanger,
means connecting the tubular riser to the flexible joint,
said tubular riser extending from said flexible joint to the floating structure,
means on said floating structure for tensioning said tubular riser,
first means for providing lateral support for said tubular riser from said floating structure at water depths greater than fifty feet, and
second means on the floating structure for providing lateral support for said tubular riser from said floating structure.

2. A marine riser according to claim 1 wherein
said flexible joint is a self-centering, resiliently loaded joint.

3. A marine riser according to claim 1, including
at least one production string extending through said tubular riser.

4. A marine riser according to claim 3, including
a centralizer within said tubular riser above said flexible joint to provide lateral support for the production string, and
a centralizer within the casing below said flexible joint to provide lateral support for the production string,
the distance from the center of rotation of the flexible joint to said upper centralizer being from 35 to 65 percent of the total distance between said centralizers.

5. A marine riser according to claim 1, wherein said flexible joint includes
means for exerting a force tending to bring said tubular riser into alignment with said casing.

6. A marine riser according to claim 1, wherein
said first support means is not below 175 feet depth of water.

7. A marine riser according to claim 1, wherein
said first support means is pivotally mounted to said floating structure whereby it may be stowed during running and retrieving of said tubular riser.

8. A marine riser according to claim 1, including
a wear sleeve surrounding the section of said tubular riser supported by said first support means.

9. A marine riser according to claim 8, wherein
said wear sleeve includes longitudinally extending external grooves in which control lines are positioned.

10. A marine riser according to claim 7, wherein said first support means includes
a pair of legs,
a collar, and
hinges for pivotally mounting one end of said legs to said floating structure,
the opposite end of said legs being secured to said collar,
said collar adapted to extend around said tubular riser.

11. A marine riser system connecting from a tension moored floating structure to a plurality of submarine, mud line suspended casings and casing hangers, comprising
a plurality of flexible joints connected to the casings,
a plurality of tubular risers connected to said flexible joints,
means on the floating structure for tensioning said tubular risers, and
means releasably interconnecting said tubular risers at a position above said flexible joints and below said floating structure whereby said risers provide support for each other, connection and release of said interconnecting means being accomplished by axial manipulation of the riser to be connected or released and are held in generally parallel relationship to each other.

12. A marine riser system according to claim 11 wherein said releasable interconnecting means includes,
arms extending outward from said risers and having a slot on some of said risers and a plug on the adjacent risers so that rotation of the risers and lifting and lowering brings the plugs and slots into and out of inter-engagement.

* * * * *